United States Patent [19]

Fast

[11] Patent Number: 5,018,287

[45] Date of Patent: May 28, 1991

[54] LABEL HOLDER FOR PARTS BIN

[76] Inventor: Jacob Fast, 7561 N.W. 9th St., Plantation, Fla. 33317

[21] Appl. No.: 420,594

[22] Filed: Oct. 12, 1989

[51] Int. Cl.[5] ..... G09F 3/18

[52] U.S. Cl. ..... 40/312; 40/661; 40/649; 206/459

[58] Field of Search ..... 40/312, 316, 641, 642, 40/649, 651, 652, 661; 206/459; 312/234.4, 234.1; 211/184, 11

[56] References Cited

U.S. PATENT DOCUMENTS 3,990,752 11/1976 Hoffman et al. ..... 206/459 X 4,318,236 3/1982 Giulini ..... 40/641 X 4,730,846 3/1988 Sheehan et al. ..... 281/45

*Primary Examiner*—Kenneth J. Dorner

*Assistant Examiner*—J. Bonifanti

*Attorney, Agent, or Firm*—Fleit, Jacobson, Cohn, Price, Holman & Stern

[57] ABSTRACT

A label holder for use on the rim of a parts bin is made of a sheet of plastic material divided by transverse fold lines into five rectangular panels. The central panel fits on top of the rim and the outer panels are bend downwardly into substantially V-shaped configurations. The outer panels snap respectively into engagement with the front and rear portions of the rim to lock the holder releasably in place. The holder can be used with adhesive and non-adhesive labels.

3 Claims, 1 Drawing Sheet

LABEL HOLDER FOR PARTS BIN

BACKGROUND OF THE INVENTION

This invention relates to a label holder for a parts bin of the type commonly used in machine shops and the like for storing a variety of articles which are frequently used in the course of the shop operations. A bin of this type, may for example, be divided by partitions into separate compartments for containing different articles, such as nuts, bolts, washers and the like and it is frequently desirable to label the different compartments to facilitate identification. For example, adjacent compartments may be used to house different size articles of similar appearance and labeling is needed in order to readily identify these.

A typical parts bin of the above type is shown, for example, in FIGS. 3 and 4 of the accompanying drawings and comprises an elongate trough-like container 10 of a molded plastic material which may, for example, be five foot six inches long with a vertical back wall 12, side walls 14, only one of which is shown, and a sloping front wall 16 lower than the back wall. The bin may be molded internally with spaced ribs 18 for receiving removable partitions 20 so that the bin may be selectively divided into convenient size compartments. The front wall 16 may terminate in a thick channel shaped rim 22 which may itself be covered by a separate channel shaped cover member 24 of hard fibrous material having a top wall 26 an inside wall 28 spaced slightly from the inside of rim 22 and an outside wall 30 extending below the rim 22. The back wall 12 of the bin may have a thick rim 32 also provided with a hardened channel-shaped cover member 34.

SUMMARY OF THE INVENTION

It is an object of the invention to provide a simple and convenient label holder for a parts bin of the type described above.

More particularly, it is an object of the invention to provide a label holder which can lock securely in place on the front rim of the bin without the use of adhesive, which can be removed, relocated, and reused as required, and which can be used to support either a non-adhesive paper label or an adhesive type label.

To meet the above and other objects, the invention provides a label holder for the purpose indicated which is formed from a blank of sheet plastic divided by transverse fold lines into a succession of five interconnected panels. The configuration of the blank is such that it can be folded substantially into a channel shape with the central panel of the five forming the top of the channel and two panels on opposite sides thereof being bent downwardly from the central panel into substantially V-shaped formations. The holder is dimensioned so that in use, one of the V formations snaps under the front wall 30 of cover 24 on the front rim 22 of the parts bin while the other V formation fits behind the rim and its terminal panel snaps between inner wall 28 of cover 24 and the back surface of the rim 22.

The label holder is extremely simple and economical to manufacture, for example by die stamping from a sheet of plastic and the holder can readily be positioned and repositioned at convenient locations along the front rim of a parts bin. A nonadhesive label can be trapped between a front panel of the holder and the front wall 30 of the bin or, alternatively, an adhesive label can be applied to the front panel of the holder.

Additional features and advantages of the invention will become apparent from the ensuing description and claims read in conjunction with the accompanying drawings.

DESCRIPTION OF PREFERRED EMBODIMENT

Figure 1:
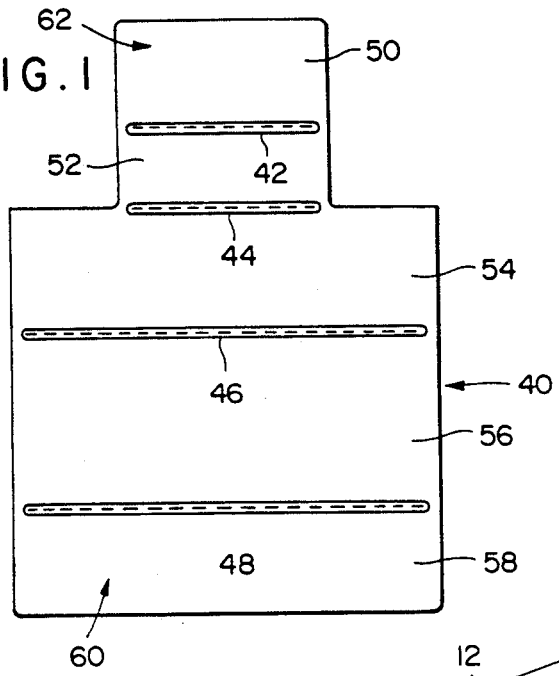
FIG. 1 is a face view of a blank for forming a label holder in accordance with the invention.

Referring initially to FIG. 1, there is shown a blank 40 die cut from sheet plastic material, the blank being divided by respective transverse indented fold lines 42–48 into five contiguous panels 50–58. It will be seen that panels 54, 56 and 58 are formed on a wider body portion 60 of the blank while the panels 50 and 52 are formed on a narrower neck portion 62 of the blank. Panel 54 is the central panel (with two panels on each side) and it will be evident that panel 52 on one side of panel 54 is considerably shorter in length (measured between the fold lines) than panel 56 on the opposite side of panel 54. This is so that the blank when folded, as will be described, can lock over respective portions of the front rim portion of the parts bin 10 described above.

Figure 2:
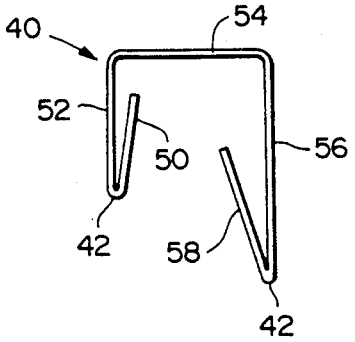
FIG. 2 is a side elevational view of a label holder folded from the blank shown in FIG. 1.

In use, the blank 40 is folded into a substantially channel shaped configuration as shown in FIG. 2. Here, panels 50 and 52 are folded down into a substantially V-configuration on one side of panel 54 and panels 56 and 58 are folded down into a substantially V-configuration on the other side of panel 54.

Figure 4:
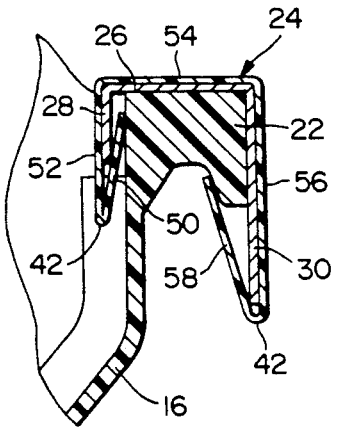
FIG. 4 is a sectional view on line 4—4 of FIG. 3.

As previously noted, the holder 40 is dimensioned to snap onto and lock in place on the front rim portion of the bin 10 and the respective panels are dimensioned accordingly. To position the holder on the bin, panel 54 is placed flat on the top wall 26 of cover 24 with panels 56 and 58 at the front or outside of the bin and panels 50 and 52 on the inside of the bin. Then, panel 58 is manipulated under and behind the bottom of outside wall 30, the holder being dimensioned such that the bottom edge of wall 30 fits substantially in the crease between panels 56 and 58 and such that panel 58 extends upwardly to engage inside of channel shaped rim 22 as shown in FIG. 4. Then, panels 50 and 52 are manipulated such that panel 50 fits in the space between wall 28 and the rear surface of rim 22. Upward pressure is then exerted on fold 42 to lock the holder in place. It will be evident that the holder may readily be removed by reversing the above procedures.

Figure 3:
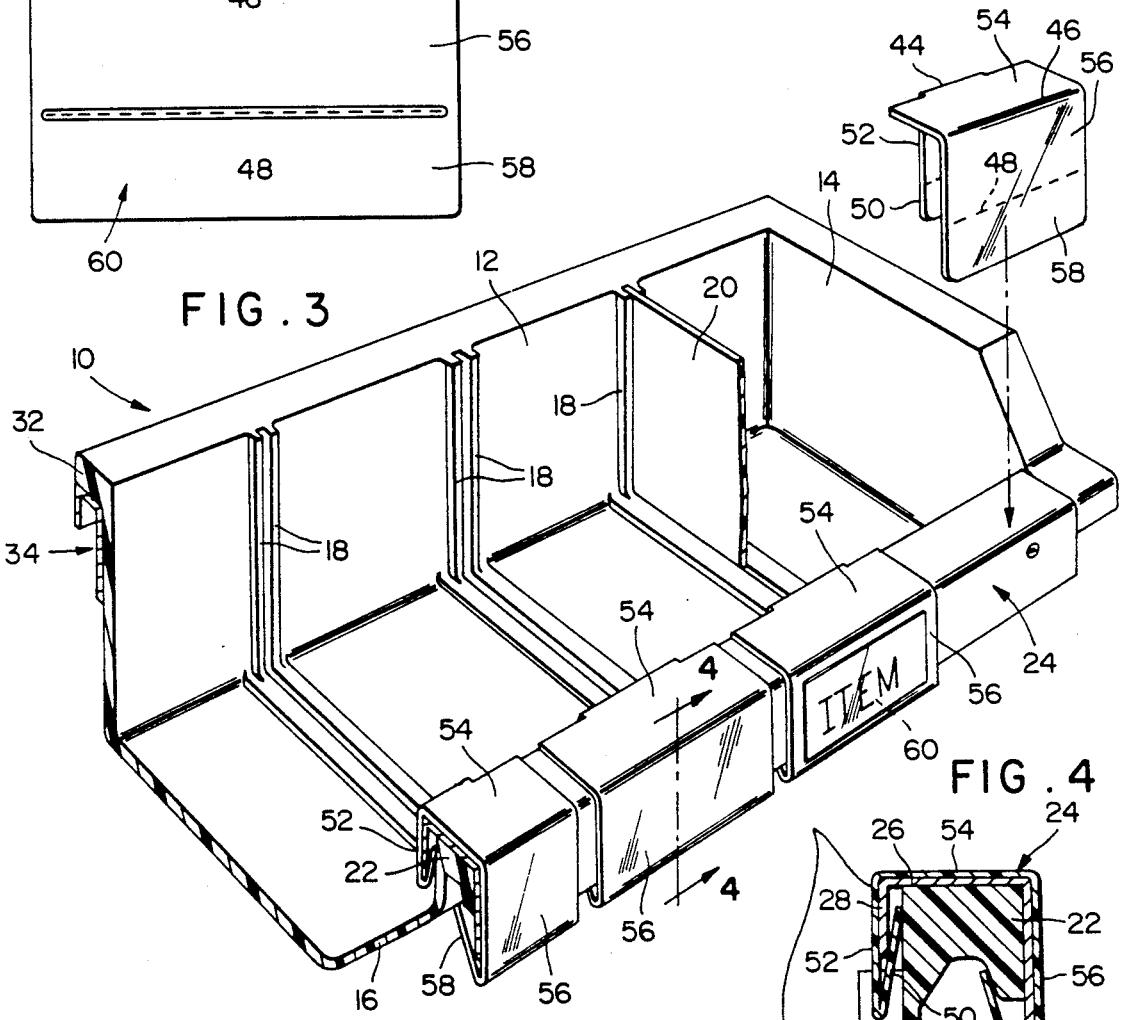
FIG. 3 is a perspective view of a parts bin showing how label holders in accordance with the invention may be mounted thereon.

The holder can be utilized to trap a non-adhesive label 60 between panel 56 and the front surface of wall 30 as shown in FIG. 3 or alternatively can be used to support an adhesive label. The holder may readily be relocated at any position along the front rim of the bin or ma be removed and reused.

While only a preferred embodiment of the invention has been described herein in detail, the invention is not limited thereby and modifications can be made within the scope of the attached claims.

I claim:

1. In combination with a parts bin of the type having a front wall with a channel-shaped rim and a channel-shaped cover element attached over the rim to provide a front outer wall extending below an outer wall of the rim, a back inner wall spaced from an inner wall of the rim, and an upper wall engaging an upper wall of the rim, a label holder of plastic sheet material fitted over the cover element, the holder being divided by transverse fold lines into five contiguous rectangular panels including a central panel on the upper wall of the cover element, a second panel extending downwardly from a front end of the central panel over the front outer wall of the cover element, a third panel extending upwardly from a lower end of the second panel and engaging an outer part of said rim, a fourth panel extending downwardly from a back end of the central panel over the back inner wall of the cover element, and a fifth panel extending upwardly from a lower end of the fourth panel into a space between the back inner wall of the cover element and the inner wall of the rim, the fifth panel releasably locking the holder in place.

2. The invention of claim 1 including a label trapped between the second panel and the front outer wall of the cover element.

3. The invention of claim 1 wherein the fourth and fifth panels are shorter in the direction of the fold lines than the first, second and third panels.

* * * * *